United States Patent [19]

Seymour et al.

[11] Patent Number: 5,070,278

[45] Date of Patent: Dec. 3, 1991

[54] DISCHARGE TUBE ARRANGEMENT

[75] Inventors: Colin J. Seymour, South Harrow; Martin C. Steel, Reading; Francis R. Trumble, Marlow Bottom, all of England

[73] Assignee: Thorn EMI plc, London, England

[21] Appl. No.: 509,548

[22] Filed: Apr. 16, 1990

[30] Foreign Application Priority Data

Apr. 15, 1989 [GB] United Kingdom ..... 8908604

[51] Int. Cl.[5] ..... H05B 41/16

[52] U.S. Cl. ..... 315/248; 315/344; 313/607

[58] Field of Search ..... 315/248, 39, 111.51, 315/111.21, 344; 313/607

[56] References Cited

U.S. PATENT DOCUMENTS 4,792,725 12/1988 Levy ..... 315/248

4,972,120 11/1990 Witting ..... 315/248

FOREIGN PATENT DOCUMENTS 0357453 3/1990 European Pat. Off. ..... 313/607

*Primary Examiner*—Eugene R. LaRoche

*Assistant Examiner*—Amir Zarabian

*Attorney, Agent, or Firm*—Fleit, Jacobson, Cohn, Price, Holman & Stern

[57] ABSTRACT

A discharge tube arrangement includes a discharge tube containing a fill and means for generating a discharge in the fill from a source of radio frequency (r.f.) power. An electrically conductive structure surrounds the discharge tube. The electrically conductive structure is formed of a plurality of waveguides which extend outwardly from the discharge tube. One or more waveguides has a cross-sectional area that increases with separation from the discharge tube. Each waveguide is dimensioned to support the propagation of electromagnetic radiation above a cut-off frequency.

6 Claims, 3 Drawing Sheets

DISCHARGE TUBE ARRANGEMENT

FIELD OF THE INVENTION

This invention relates to a discharge tube arrangement and in particular, though not exclusively, to such an arrangement for use as a light source.

BACKGROUND OF THE INVENTION

It is known e.g. as disclosed in EP 0225753A (University of California), to generate and sustain a low pressure discharge in a gas by using electromagnetic surface waves. Surface waves are created by an energizer (also known as a launcher) which is positioned around and external of, but not extending the whole length of, a discharge tube containing the gas. In such an arrangement, it is not necessary to provide electrodes inside the discharge tube. The power to generate the electromagnetic wave is provided by a radio frequency (r.f.) power generator and EP 0225753A further discloses a grounded transparent r.f. shield surrounding the discharge tube.

It is envisaged that the radio frequency used can fall in the range of from 1 MHz to 1 GHz. However, in practice, it is believed that the operating frequencies which can be utilised by a discharge tube arrangement for use as a light source will be around 20 MHz, around 84 MHz or around 900 MHz, probably in the range of from 13 to 30 MHz.

It is known to provide a Faraday cage, e.g. a wire mesh, around a structure that is energised by radio frequency (r.f.) power to act as an r.f. screening structure. The size of such a mesh is dependent, inter alia, on the frequency of the r.f. power used and the attenuation in r.f. power emitted that is required. To produce an attenuation of, say, 30 dB at the frequencies of interest, the mesh used would be very fine, with a mesh size of the order of millimetres. This would tend to obscure light from the discharge tube, making the discharge tube arrangement an inefficient light source. A requirement for a higher attenuation to reduce the amount of r.f. interference to comply with international regulations would exacerbate the problem.

OBJECT OF THE INVENTION

It is an object of the present invention to provide an improved discharge tube arrangement for use, inter alia, as a light source.

SUMMARY OF THE INVENTION

According to the present invention there is provided a discharge tube arrangement comprising:

a discharge tube containing a fill; means for generating a discharge in the fill from a source of radio frequency (r.f.) power;

land an electrically conductive structure mounted on and surrounding the discharge tube wherein said structure comprises a plurality of waveguides extending outwardly from the discharge tube, said waveguides defining spaces each having a cross-sectional area that increases from a position adjacent the discharge tube to a radially outward position, each waveguide being dimensioned to support the propagation of electromagnetic radiation above a cut-off frequency. In practice, said structure would, in use, be connected to an earth for safety.

In a discharge tube arrangement provided in accordance with the present invention, the waveguides of the structure are demensioned so as to support the propagation of visible light but not of r.f. radiation. A typical cut-off frequency would be of the order of 8 GHz. The waveguides allow electromagnetic radiation of wavelength less than a multiple of the greatest cross-sectional dimension of the waveguides at the end nearest the discharge tube to propagate freely. This multiple is dependent on the cross-section of the waveguides and is two for waveguides of rectangular cross-section. Radiation of wavelengths greater than this are attenuated. The variation in cross-sectional area of one or more of the waveguides allows the structure to be constructed so as to reduce the attenuation of radiation of visible wavelengths which would otherwise be caused by the physical presence of the walls of the waveguides.

The propagation constant $\alpha$ of a wave in a rectangular waveguide of constant cross-sectional area is given by:

$$\gamma = \frac{2\pi}{\lambda_o}\sqrt{\left(\frac{\lambda_o}{\lambda_c}\right)^2 - 1} = \alpha + j\beta$$

where $\lambda o$ = free-space wavelength of the wave $\lambda c$ = wavelength at which the waveguide ceases to support a freely propagating wave.

$\alpha$ = attenuation coefficient $\beta$ = phase coefficient

If $\lambda o/\lambda c > 1$, $\gamma$ is real and the wave is attenuated

If $\lambda o/\lambda c < 1$ $\gamma$ is imaginary and the wave will propagate.

Electromagnetic radiation propagates through a waveguide in a number of modes, but for the dominant mode of propagation ($TE_{10}$ —transverse electric) $\lambda c = 2a$ where a is the greater cross-sectional dimension of the waveguide.

If the waveguide has a taper in the direction x along which the wave passes such that a changes from a1 to a2, then the attenuation coefficient $\alpha_T$ is given by:

$$\alpha_T = \int_{a1}^{a2} \alpha(x)dx$$

$$= \frac{2\pi}{\lambda_o}\int_{a1}^{a2}\sqrt{\left(\frac{\lambda_o}{\lambda c}\right)^2 - 1}\, dx$$

$$\alpha_T \sim 2\pi \int_{a1}^{a2} \frac{1}{\lambda_c}\, dx$$

$$\text{for } TE_{10} \text{ mode, } \alpha_T \sim \int_{a1}^{a2} 1/a(x)dx$$

Hence the attenuation due to a tapered section of a waveguide can be readily calculated.

Preferably the generating means comprises a launcher suitable, when energised with r.f. power, for exciting surface waves in the fill, the discharge tube being positioned in part within the launcher. Discharges excited by surface waves have a number of advantages over other types of r.f. discharges.

Each waveguide may have a rectangular cross-section for ease of construction. Other cross-sections, e.g. hexagonal, circular, star-shaped, may also be used for aesthetic purposes.

Advantageously, the walls of the waveguides extend normally outward from the wall of the discharge tube to provide minimal attenuation of visible radiation. Where the discharge tube is circular in cross-section, the walls of the waveguides preferably extend radially outwards from the discharge tube.

BRIEF DESCRIPTION OF DRAWINGS

An embodiment of the present invention will now be described, by way of example only, and with reference to the accompanying drawings of which.

DESCRIPTION OF PREFERRED EMBODIMENT

Figure 1:
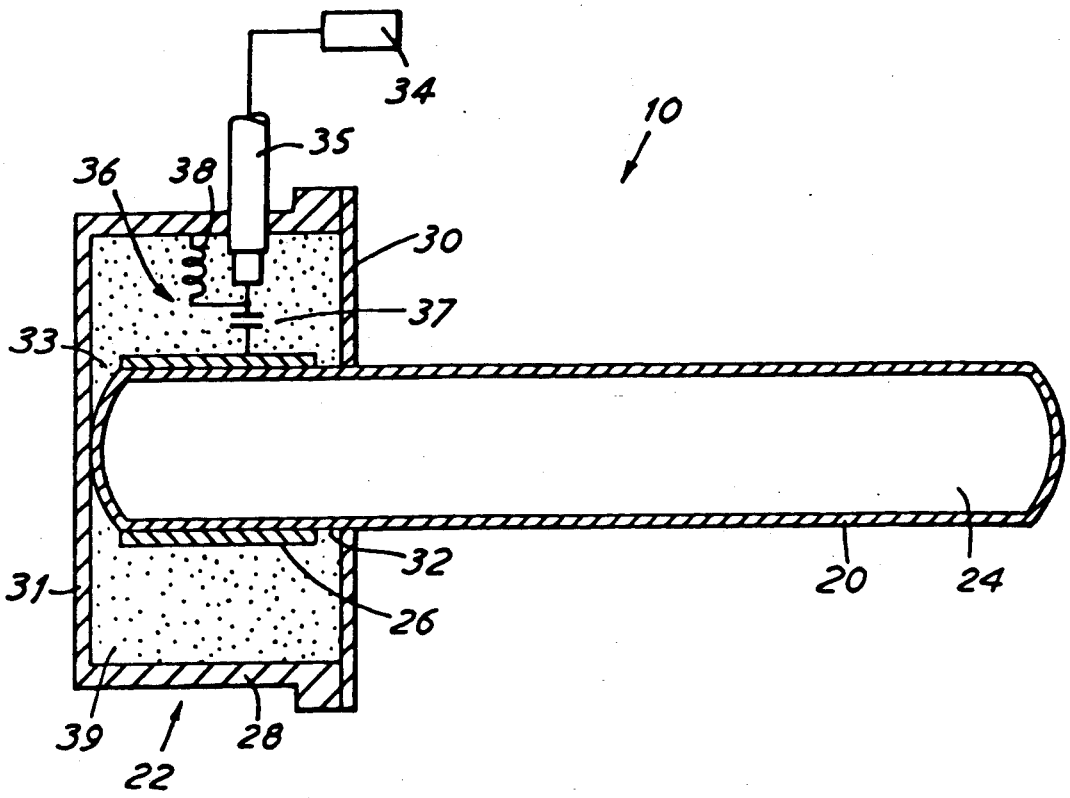
FIG. 1 shows a discharge tube arrangement not provided in accordance with the present invention.

FIG. 1 shows a discharge tube arrangement, 10 known to the inventors comprising a discharge tube 20 mounted in a launcher 22. The discharge tube 20 is formed of a light-transmissive, dielectric material, such as glass, and contains a fill 24 of a noble gas, such as argon and an ionizable material, such as mercury.

The launcher 22 is made of an electrically conductive material, such as brass, and formed as a coaxial structure comprising an inner tube 26 and an outer tube 28. A first plate 30, at one end of the outer tube, provides a first end wall for the launcher structure. At the other end of the outer tube 28, a second plate 31, integral with the outer tube 28, provides a second end wall. The inner tube 26 is shorter than the outer tube 28 and so positioned within the outer tube 28 as to define a first annular gap 32 and a second annular gap 33. The first plate 30 has an aperture for receiving the discharge tube 20. The outer tube 28, the first plate 30 and the second plate 31 form an unbroken electrically conductive path around, but not in electrical contact with, the inner tube 26 to provide an r.f. screening structure therearound.

Suitable dimensions for the launcher of FIG. 1 are as follows:

| | |
|---|---|
| Launcher length | 7–20 mm |
| Launcher diameter (outer tube 28 diameter) | 25–35 mm but depends on size of discharge tube 20. |
| Inner tube 26 length | 3–18 mm |
| Inner tube 26 diameter | 13 mm but depends on size of discharge tube 20. |
| Length of Launching gap (first gap 32) | 0.5–3 mm |
| Length of second gap 33 | 1–10 mm |

The thickness of the electrically conductive material is of the order of millimetres, or less, depending on the construction method used.

An r.f. power generator 34 (shown schematically) is electrically connected to the inner tube 26 of the launcher 22 via a coaxial cable 35 and an impedance matching network 36 (shown schematically as comprising capacitor 37 and inductor 38). The inner tube 26 is, in this way, earthed. The r.f. power generator 34, the impedance matching network 36, the coaxial cable 35 and the launcher 22 constitute an r.f. powered excitation device to energise the fill to produce a discharge.

A body 39 of dielectric material inside the launcher 22 is provided as a structural element, to keep the size of the gaps. 32, 33 constant and to hold the inner tube 26 in position. The body 39 also helps in shaping the electric field in the gaps 32, 33 for ease of starting or other purposes. Suitable dielectric materials which exhibit low loss at r.f. frequencies include glass, quartz and PTFE.

When the r.f. power supply 34 is switched on, an oscillating electric field, having a frequency typically in the range of from 1 MHz to 1 GHz, is set up inside the launcher 22. At the first and second gap 32, 33, this electric field is parallel to the longitudinal axis of the discharge tube 20. If sufficient power is applied, the consequent electric field produced in the fill 24 is sufficient to create a discharge through which an electromagnetic surface wave may be propagated in a similar manner to the arrangement of EP 0225753A. The first gap 32 is effective as the launching gap while the second gap 33 complements the effect of the first gap 32. Accordingly, the launcher 22 powered by the r.f. power generator 34 creates and sustains a discharge in the fill.

The length and brightness of the discharge depends, inter alia, on the size of the discharge tube 20 and the power applied by the r.f. power generator 34.

Figure 2:
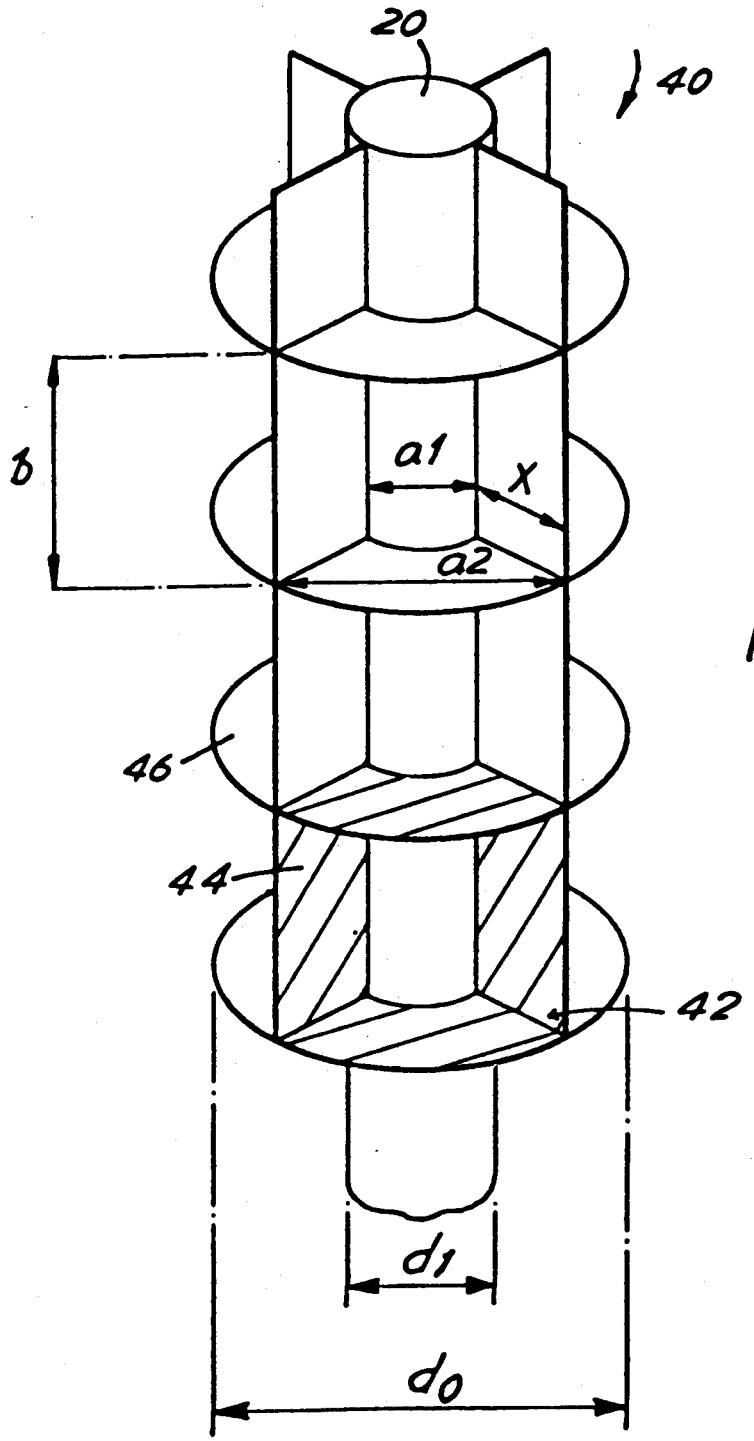
FIG. 2 shows schematically part of a discharge tube arrangement provided in accordance with the present invention.

FIG. 2 shows part of the discharge tube arrangement 10 of FIG. 1 modified in accordance with the present invention. The discharge tube 20 which is of circular cross-section is positioned centrally within a structure 40 consisting of a network of small tapered waveguides, one shaded in and referenced generally as 42. The structure 40 is formed from thin beryllium/copper sheet, though any electrically conductive material may be used, cut into strips 44 and flat annular discs 46 to produce waveguides 42 defining spaces having a rectangular cross-section considered from a position adjacent the tube 20 to a radially outward position extending outwardly from the discharge tube 20. The walls of the waveguides 42 are normal to the wall of the discharge tube extending radially outward therefrom.

The dimensions of the discharge tube arrangement when energised with r.f. power at 84 MHz are as follows:

Diameter of discharge tube ($d_T$)=13 mm

Diameter of metal discs 46 ($d_D$)=30 mm

Length of discharge tube 20 outside launcher=125 mm.

Figure 3:
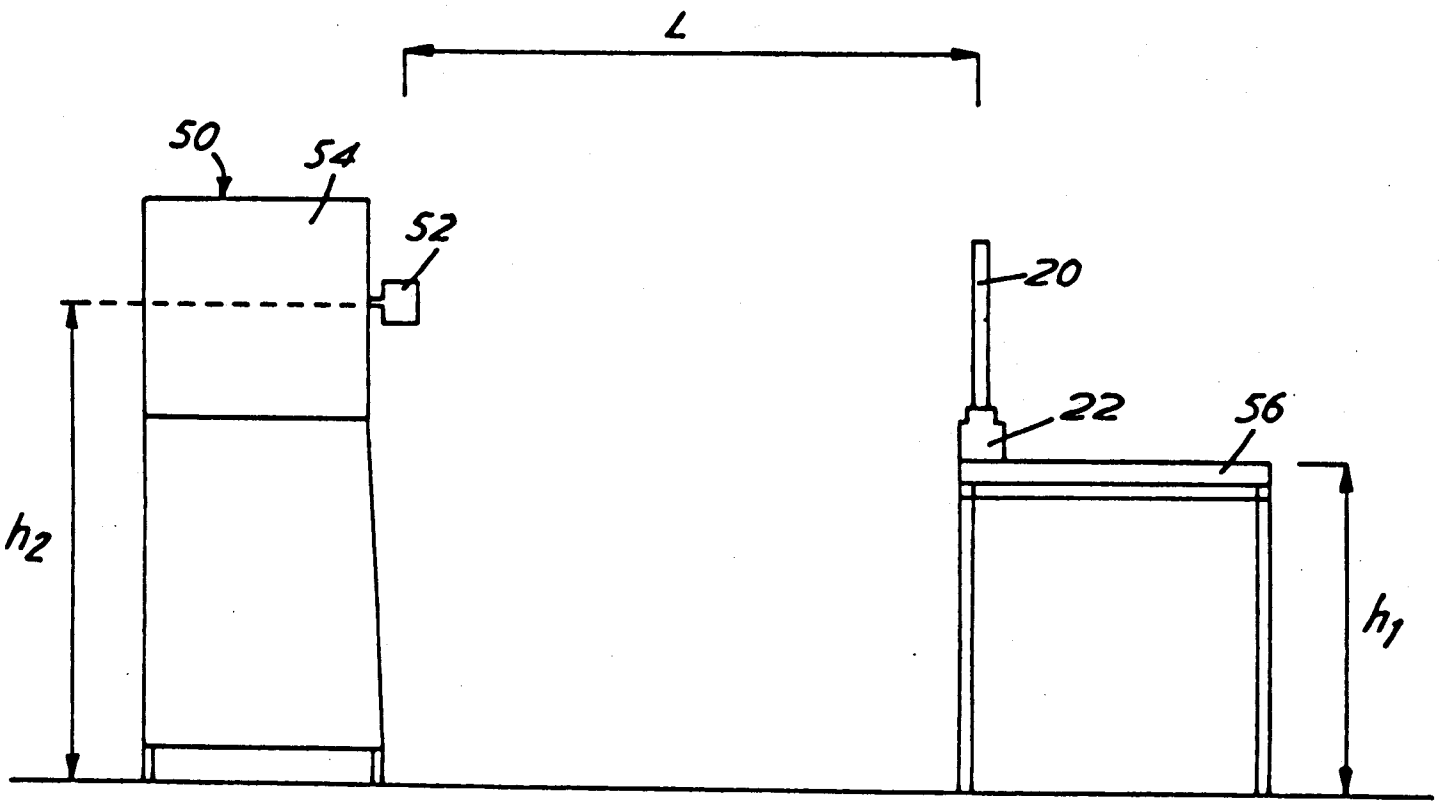
FIG. 3 shows an apparatus for making relative measurements of r.f. power emitted by a discharge tube arrangement.

The attenuation of emitted r.f. power caused by the structure 20 was measured using an apparatus 50 as shown in FIG. 3 which is capable of making relative measurements of radiated r.f. power. The apparatus 50 comprises a polarisation insensitive antenna 52 connected to a spectrum analyser 54. The device under test, shown schematically as a discharge tube 20 and launcher 22 was placed on a bench 56 of height $h_1$=73 cm. The antenna 52 was positioned at a height $h_2$ of 102 cm and a distance L=125 cm away from the discharge tube.

The attenuation for a number of different structures 40 was measured and compared with the theoretical attenuation for the three most dominant modes of propagation $TE_{10}$, $TE_{11}$ and $TE_{12}$ as shown below.

| Number of discs 46 | Number of Strips 44 | Attenuation/dB Theory $TE_{10}$ | $TE_{11}$ | $TE_{12}$ | Experiment |
|---|---|---|---|---|---|
| 6 | 6 | 23 | 26 | 35 | 28 |
| 3 | 6 | 23 | 24 | 27 | 22 |
| 3 | 3 | 13 | 15 | 20 | 22 |

-continued

| Number of discs 46 | Number of Strips 44 | Attenuation/dB Theory $TE_{10}$ | $TE_{11}$ | $TE_{12}$ | Experiment |
|---|---|---|---|---|---|
| 6 | 3 | 13 | 19 | 29 | 24 |

The first two cases are in good agreement with predictions for the $TE_{10}$ mode and discrepancies for the other two cases may be due to the presence of a mixture of modes.

Suppression of the first harmonic at 168 MHz was also observed experimentally showing that the structure 40 is effective at the higher frequency.

It is envisaged that the shielding effect of the structure 40 can be further improved by increasing the diameter $d_D$ of the discs and hence the length of the waveguides. Predicted attenuation by a structure comprising 6 discs 46 and 6 strips 44 is shown below.

| Disc Diameter/cm | Predicted attenuation/dB $TE_{10}$ | $TE_{11}$ | $TE_{12}$ |
|---|---|---|---|
| 3 | 23 | 26 | 35 |
| 4 | 31 | 37 | 52 |
| 5 | 36 | 47 | 68 |
| 6 | 41 | 56 | 85 |
| 10 | 55 | 90 | 147 |

To produce an attenuation of about 25 dB at a frequency of 84 MHz, a Faraday cage would have a mesh hole size of about 3 mm. If to improve the shielding effect, the holes were made even smaller then, as outlined hereinbefore, the obscuration of visible light may become prohibitive. The shielding effect of the structure in a discharge tube arrangement provided in accordance with the present invention is produced in part by the depth of the structure and so larger holes can be used and the problem of obscuration alleviated.

If the structure 40 is placed in close proximity with, preferably touching, the discharge tube then it has been found that the light output from the discharge tube is increased and this increase may be greater than the reduction in light output caused by obscuration.

It is envisaged that the structure could be silvered or polished to form part of a luminaire. A similar structure could be provided for discharge tubes of non-circular cross-section.

Other modifications to the embodiment described within the scope of the present invention will be apparent to those skilled in the art.

We claim:

1. A discharge tube comprising:

a discharge tube containing a fill;

means for generating a discharge in the fill from a source of radio frequency (r.f.) power;

and an electrically conductive structure mounted on and surrounding the discharge tube wherein said structure comprises a plurality of waveguides extending outwardly from the discharge tube, said waveguides defining spaces each having a cross-sectional area that increases from a position adjacent the discharge tube to a radially outward position, each waveguide being dimensioned to support the propagation of electromagnetic radiation above a cut-off frequency.

2. A discharge tube arrangement according to claim 1 wherein the generating means comprises a launcher suitable, when energised with r.f. power, for exciting surface waves in the fill, the discharge tube being positioned in part within the launcher.

3. A discharge tube arrangement according to claim 1 wherein each waveguide has a rectangular cross-section.

4. A discharge tube arrangement according to claim 1 wherein the walls of the waveguides extend normally outward from the wall of the discharge tube.

5. A discharge tube arrangement according to claim 1 wherein the discharge tube is circular in cross-section and the walls of the waveguides extend radially outwards from the discharge tube.

6. A discharge tube arrangement according to claim 3 wherein the structure is formed from a reflective material.

* * * * *